US009027211B2

(12) United States Patent
Cheng

(10) Patent No.: US 9,027,211 B2
(45) Date of Patent: May 12, 2015

(54) FASTENING STRAP AND MANUFACTURING METHOD THEREOF

(75) Inventor: Sen-Mei Cheng, Ho Mei Town (TW)

(73) Assignee: Taiwan Paiho Limited, Chang Hua County (TW)

( * ) Notice: Subject to any disclaimer, the term of this patent is extended or adjusted under 35 U.S.C. 154(b) by 355 days.

(21) Appl. No.: 13/457,689

(22) Filed: Apr. 27, 2012

(65) Prior Publication Data

US 2012/0204385 A1 Aug. 16, 2012

Related U.S. Application Data

(63) Continuation-in-part of application No. 12/354,834, filed on Jan. 16, 2009, now abandoned.

(30) Foreign Application Priority Data

Oct. 21, 2008 (TW) ..... 97140242 A

(51) Int. Cl.

| | |
|---|---|
| ***A44B 18/00*** | (2006.01) |
| ***B65D 63/10*** | (2006.01) |
| ***G09F 3/00*** | (2006.01) |
| ***G09F 3/14*** | (2006.01) |

(52) U.S. Cl.

CPC ..... *B65D 63/1018* (2013.01); *Y10T 24/2758* (2015.01); *A44B 18/00* (2013.01); *B65D 2313/02* (2013.01); *G09F 3/005* (2013.01); *G09F 3/14* (2013.01)

(58) Field of Classification Search

CPC .. B65D 63/1018; B65D 2313/02; G09F 3/14; G09F 3/005; A44B 18/00

USPC ..... 24/306, 445–448, 452

See application file for complete search history.

(56) References Cited

U.S. PATENT DOCUMENTS

| | | | | |
|---|---|---|---|---|
| 4,984,339 | A * | 1/1991 | Provost et al. | 24/452 |
| 6,174,476 | B1 * | 1/2001 | Kennedy et al. | 264/167 |
| 6,684,464 | B1 | 2/2004 | Mody et al. | |
| 8,402,615 | B2 * | 3/2013 | Cheng | 24/452 |
| 2003/0182776 | A1 * | 10/2003 | Ausen et al. | 24/452 |
| 2004/0068848 | A1 * | 4/2004 | Ausen et al. | 24/452 |
| 2004/0258902 | A1 * | 12/2004 | Seth et al. | 428/315.7 |
| 2006/0200952 | A1 | 9/2006 | Clarner | |

FOREIGN PATENT DOCUMENTS

| | | |
|---|---|---|
| JP | 2001-008712 | 1/2001 |

* cited by examiner

*Primary Examiner* — Robert J Sandy
*Assistant Examiner* — Rowland Do
(74) *Attorney, Agent, or Firm* — Ming Chow; Sinorica, LLC

(57) ABSTRACT

A fastening strap and a manufacturing method thereof are provided. The fastening strap includes a first band and a second band. The first band has a first surface and a second surface. The first surface has a plurality of hooks of special configuration. The second band has a third surface and a fourth surface. The third surface is directly adhered to the second surface of the first band, and the fourth surface has a plurality of loops for being mechanically latched by the hooks on the first surface. The second surface and/or the third surface is printed with at least one pattern. After the first band and the second band are adhered together, the pattern can be seen from the first surface of the first band.

1 Claim, 10 Drawing Sheets

FASTENING STRAP AND MANUFACTURING METHOD THEREOF

CROSS-REFERENCE TO RELATED APPLICATION

This application is a Continuation in-part of U.S. patent application Ser. No. 12/354,834 entitled "FASTENING STRAP AND MANUFACTURING METHOD THEREOF" filed on Jan. 16, 2009 now abandoned which claimed a foreign priority of TW 097140242, filed on Oct. 21, 2008.

BACKGROUND OF THE INVENTION

1. Technical Field

The present invention relates to a fastening strap and a manufacturing method thereof. More particularly, the present invention relates to a fastening strap having specially configured hooks and a pattern printed on at least one band of the fastening strap, and a manufacturing method of the fastening strap.

2. Description of Related Art

The hook-and-loop fastener, or better known by the brand name Velcro, was invented by George de Mestral, a Swiss engineer, under the inspiration of burrs. The hook-and-loop fastener consists of two layers of fabric, namely a hook side and a loop side. The hook side is a layer of fabric woven with tiny hooks. The loop side is another layer of fabric covered with even smaller and finer loops. When the hook side and the loop side are pressed together, the hooks on the hook side are caught in the loops on the loop side so that the two sides are fastened together.

The hook-and-loop fastener is convenient to use and has found various applications where fastening is desired. In addition, the hook-and-loop fastener can be printed with special marks or patterns to serve esthetic or publicity purposes. A pattern can be printed on the hook-and-loop fastener mainly in two ways, as disclosed in U.S. Pat. No. 6,684,464. The first way is to print the pattern on an outer surface of the hook side or the loop side after the two sides are adhered back-to-back together. Alternatively, the pattern is printed on an additional layer of material, which is then bonded with the hook side and the loop side. The first approach is disadvantageous in that the pattern printed on the outer surface of the hook side or the loop side tends to peel off and become unsightly after frequent use of the hook-and-loop fastener. On the other hand, the extra layer of material in the second approach incurs additional production cost.

BRIEF SUMMARY OF THE INVENTION

Hence, the present invention provides a fastening strap to solve the aforementioned problems. The fastening strap according to the present invention also provides the improvement over the conventional hook structure of the hook-and-loop fastener such that not only the hook side and the loop side can be fastened together more easily and then separated from each other with less effort, but also the hook structure of the present invention is more resistant to lateral pulling forces and thus produces a better fastening effect.

It is an objective of the present invention is to provide a fastening strap that allows a pattern to be printed on bonding surfaces of two bands of the fastening strap and thereby prevents the pattern from being easily damaged by frequent use of the fastening strap.

It is another objective of the present invention is to provide a fastening strap formed with hooks of a special configuration that not only allows the hooks to fasten easily with loops of the fastening strap, but also allows separation of the hooks and the loops to be done without much effort.

It is a further objective of the present invention is to provide a fastening strap formed with a plurality of hooks, in which each the plurality of hooks having two opposite hook portions so that, when the hook portion on one side of a certain hook is pulled laterally, the hook portion on the other side of the hook is pressed against and thus supports the laterally pulled hook portion, thereby providing the hook with enhanced resistance to lateral pulling forces.

According to above objectives, the present invention provides a fastening strap including a first band and a second band. The first band is made of a transparent material and has a first surface and a second surface, wherein the first surface is protrudingly provided with a plurality of hooks. The second band has a third surface and a fourth surface, wherein the third surface is directly adhered to the second surface of the first band, and the fourth surface is formed with a plurality of loops for being mechanically latched by the plurality of hooks on the first surface. The second surface or the third surface is printed with at least one pattern. After the first band and the second band are adhered together, the pattern is visible through the first surface of the first band. The hooks of the fastening strap according to the present invention are characterized in that each of the plurality of hooks is formed with a stem portion with one end of the stem portion being attached to the first surface and the other end of the stem portion being provided with two hook portions extending therefrom in opposite direction, respectively. Moreover, the stem portion is tapered upward from the first surface and widened toward the two hook portions and a concave portion having a nadir is formed between the two hook portions. Each of the two hook portions has an upper surface with an upper-surface apex, and a lower surface with a lower-surface apex, wherein a vertical distance between the lower-surface apex and a distal end of the lower surface of the hook portion is smaller than a vertical distance between the lower-surface apex and the upper-surface apex, and the vertical distance between the lower-surface apex and the upper-surface apex is smaller than a vertical distance between the nadir and the upper-surface apex.

The present invention also provides a fastening strap including a first band and a second band. The first band is made of a transparent material and has a first surface and a second surface, wherein the first surface is protrudingly provided with a plurality of hooks. The second band has a third surface and a fourth surface, wherein the third surface is directly adhered to the second surface of the first band, and the fourth surface is formed with a plurality of loops for being mechanically latched by the plurality of hooks on the first surface. Both the first band and the second band of the fastening strap are made of a thermoplastic material. The second surface or the third surface is printed with at least one pattern. After the first band and the second band are bonded together by a thermoplasticizing process, the pattern is visible through the first surface of the first band.

BRIEF DESCRIPTION OF THE SEVERAL VIEWS OF THE DRAWINGS

The invention as well as a preferred mode of use, further objectives and advantages thereof will be best understood by referring to the following detailed description of illustrative embodiments in conjunction with the accompanying drawings, wherein.

DETAILED DESCRIPTION OF THE INVENTION

The present invention relates to a fastening strap as an improvement over the existing hook-and-loop fastener, and a manufacturing method of the fastening strap. Since the principles for fastening together the hook side and the loop side of the hook-and-loop fastener are well known to people of ordinary skill in the art, a detailed description of such principles will be omitted herein. Besides, the drawings referred to in the following description are not drawn according to actual dimensions and need not be so because they are intended to demonstrate features of the present invention only schematically.

Figure 1A:
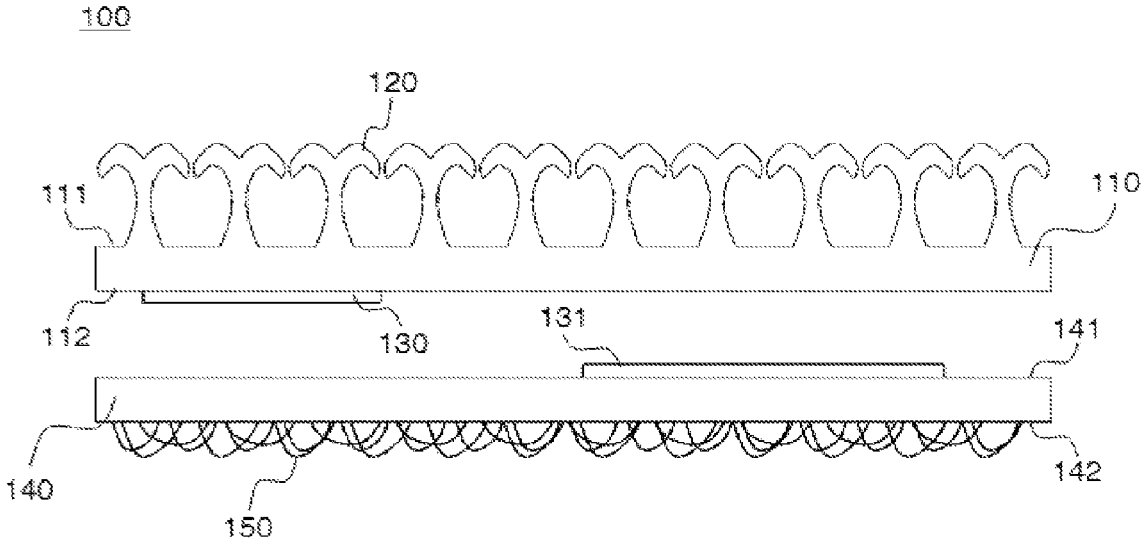
FIG. 1A is a sectional view of a fastening strap according to a first embodiment of the present invention.

Referring to FIG. 1A, a fastening strap 100 according to a first embodiment of the present invention essentially includes a first band 110 and a second band 140. The first band 110 is made of a transparent material and has a first surface 111 and a second surface 112. The first surface 111 of the first band 110 is protrudingly provided with a plurality of hooks 120. At least one pattern 130, either monochromatic or multicolored, is printed on a suitable location on the second surface 112, and the pattern 130 is visible through the first surface 111 of the first band 110 after the first band 110 and the second band 140 are adhered together. Since the pattern 130 is not exposed to the outside, it is unlikely to be damaged by frequent use of the fastening strap 100. It should be noted that the pattern 130 in FIG. 1A includes a very thin layer of ink only where there is a graphic design in the pattern 130, and the pattern 130 includes no material at all in areas outside the graphic design. This distinguishes the present invention from the above-cited U.S. Pat. No. 6,684,464 wherein a middle layer printed with a barcode is adhered between the hook side and the loop side. The fastening strap according to the present invention shows significant improvement over the U.S. Pat. No. 6,684,464 in having a smaller overall thickness and allowing the location and content of the pattern 130 to be arbitrarily set.

The second band 140 has a third surface 141 and a fourth surface 142. The third surface 141 of the second band 140 is adhered directly to the second surface 112 of the first band 110. The fourth surface 142 is formed with a plurality of loops 150 for being mechanically latched by the hooks 120 on the first surface 111. The second band 140 may also be made of a transparent material so that the pattern 130 is visible through the fourth surface 142 of the second band 140, too. The third surface 141 of the second band 140 may be further printed with at least one monochromatic or multicolored pattern 131, which is visible through the first surface 111 of the first band 110 as well as the fourth surface 142 of the second band 140 after the first band 110 and the second band 140 are adhered together.

Figure 1B:
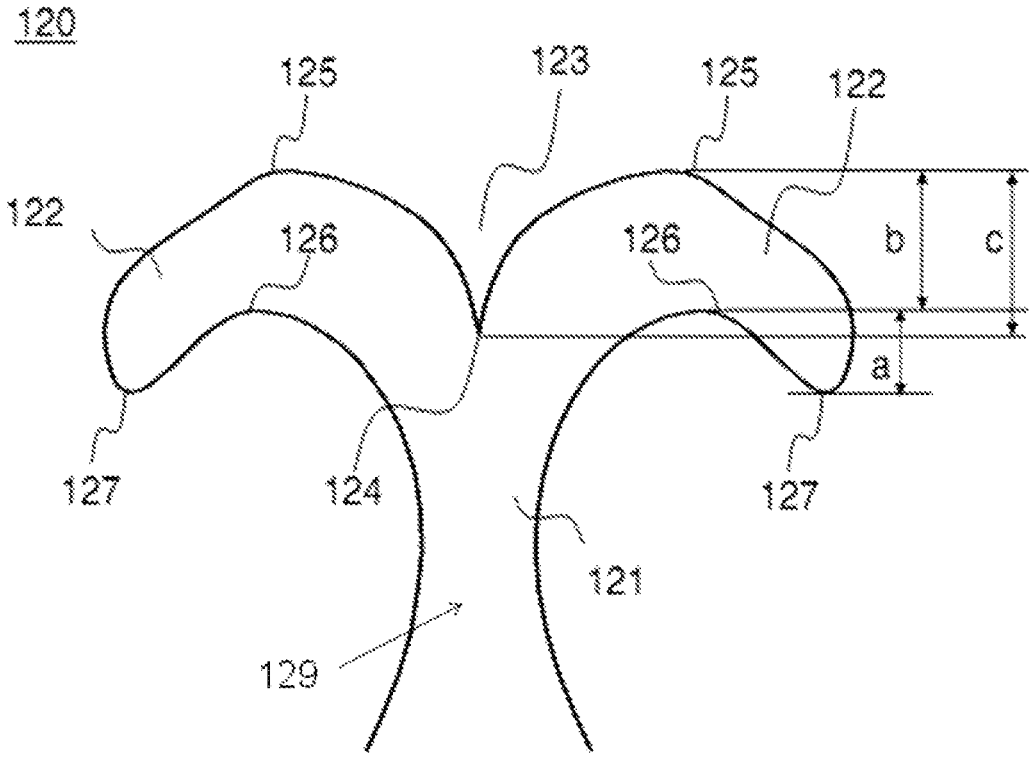
FIG. 1B is an enlarged view of a hook of the fastening strap according to the first embodiment of the present invention.

Please refer now to FIG. 1B for an enlarged view of one of the hooks of the fastening strap according to the first embodiment of the present invention. As shown in the drawing, each the plurality of hook 120 is formed with a stem portion 129. The stem portion has one end thereof being attached to the first surface 111 and the other end thereof being provided with two hook portions 122 extending therefrom in opposite directions, respectively. In the embodiment of the invention, the stem portion 129 has a neck 121, which is the narrowest part of the stem portion 129. The part below the neck 121 of the stem portion 129 is tapered upward from the first surface 111 and the part above the neck 121 of the stem portion 129 is widened toward the two hooks portions 122 and a concave portion 123 having a nadir 124 is formed between the two hook portions 122. Each of the hook portions 122 has an upper surface with an upper-surface apex 125, and a lower surface with a lower-surface apex 126. A vertical distance between the lower-surface apex 126 and a distal end 127 of the lower surface of the hook portion 122 is defined as a, and a vertical distance between the lower-surface apex 126 and the upper-surface apex 125 is defined as b, wherein $a<b$. In addition, a vertical distance between the nadir 124 and the upper-surface apex 125 is defined as c, and $b<c$.

In the embodiment of the present invention, each the plurality of hooks 120 having two opposite hook portions 122, so that when the hook portion 122 on one side of a certain hook is pulled laterally, the hook portion 122 on the other side of each the plurality of hooks 120 is pressed against and thus supports the laterally pulled hook portion 122, thereby each the plurality of hooks 120 can be provided with enhanced resistance to lateral pulling forces.

Figure 1C:
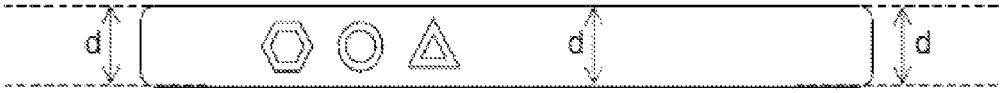
FIGS. 1C through 1H show various aspects of head ends and tail ends of the fastening strap according to the first embodiment of the present invention.
Figure 1D:
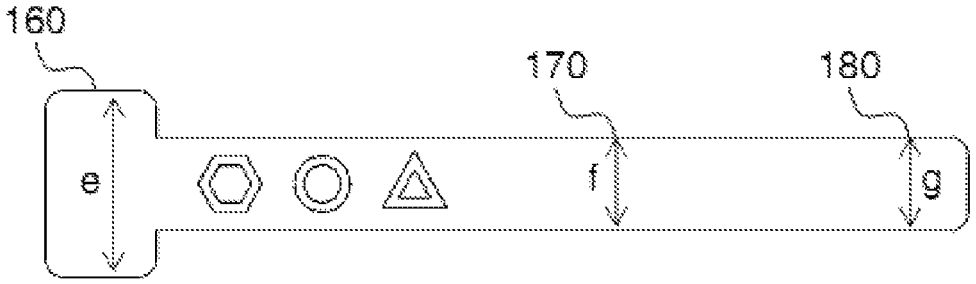
Figure 1E:
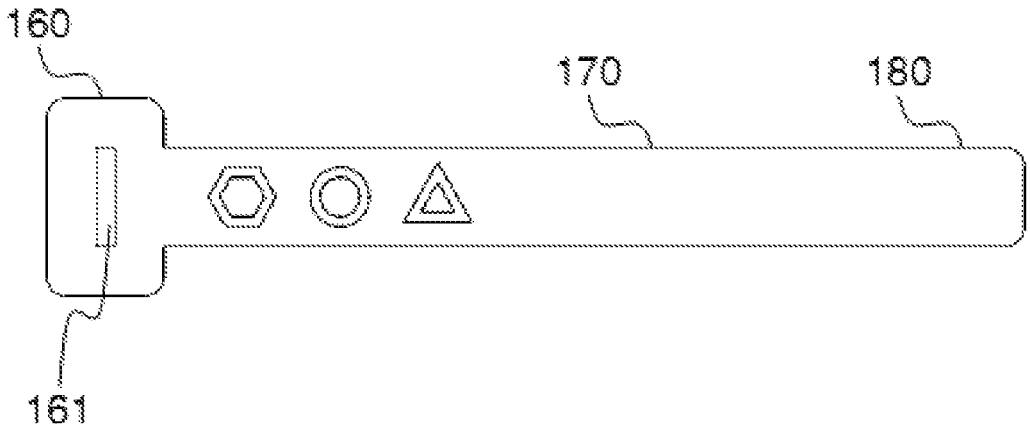

FIG. 1C shows one aspect of the fastening strap according to the first embodiment of the present invention, wherein the fastening strap 100 has a uniform width d lengthwise. Alternatively, the fastening strap 100 may have different shapes to suit different purposes and needs. As shown in FIGS. 1D and 1E, the fastening strap 100 is defined lengthwise with a head end 160 having a width e, a tail end 180 located opposite the head end 160 and having a width g, and a middle section 170 situated between the head end 160 and the tail end 180 and having a width f, wherein the head end width e is greater than or equal to the middle section width f, that is, $e \geq f$, and the head end 160 may have an arbitrary shape. In FIG. 1D, the fastening strap 100 has its head end width e greater than the middle section width f, which is equal to the tail end width g. The fastening strap 100 shown in FIG. 1E has the same aspect as that shown in FIG. 1D, except that the head end 160 in FIG. 1E is further formed with an opening 161 for the tail end 180 to pass through.

Figure 1F:
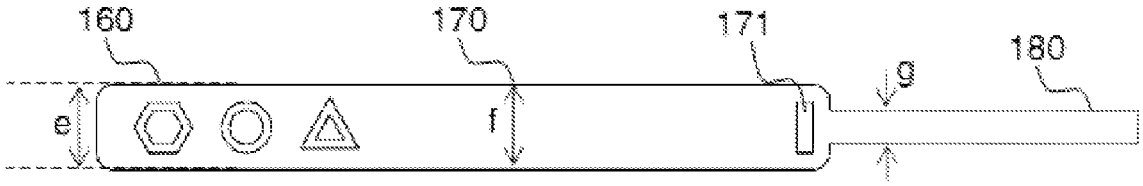
Figure 1G:
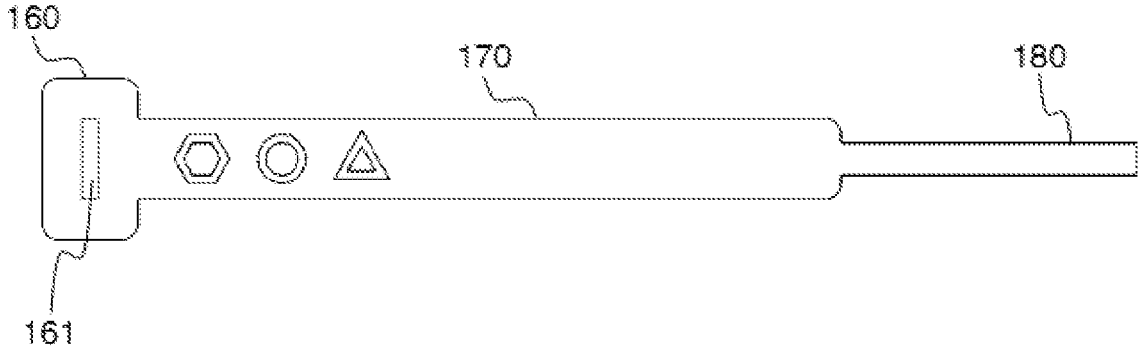
Figure 1H:
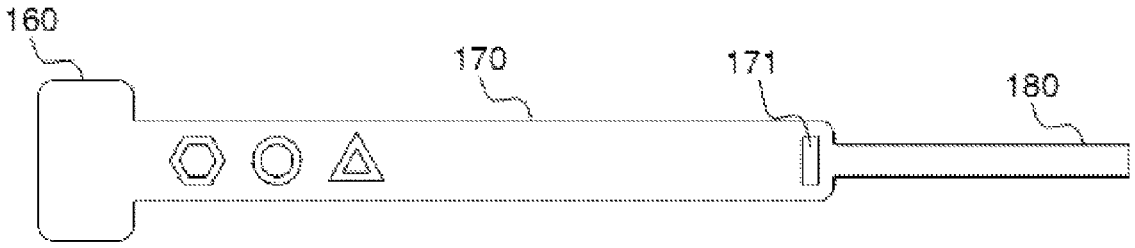

Refer now to FIG. 1F through FIG. 1H, wherein the fastening strap 100 has its tail end width g smaller than the middle section width f, that is, $e \geq f$ and $g<f$. In FIG. 1F, the fastening strap 100 has its head end width e equal to the middle section width f, and the tail end width g smaller than the middle section width f, while an opening 171 is further formed in the middle section 170 adjacent to the tail end 180 for the tail end 180 to pass through. In FIG. 1G, the fastening strap 100 has its head end width e greater than the middle section width f, and the tail end width g smaller than the middle section width f, while an opening 161 is further formed in the head end 160 for the tail end 180 to pass through. In FIG. 1H, the fastening strap 100 has its head end width e greater than the middle section width f, and the tail end width g smaller than the middle section width f, while an opening 171 is further formed in the middle section 170 adjacent to the tail end 180 for the tail end 180 to pass through.

Figure 2:
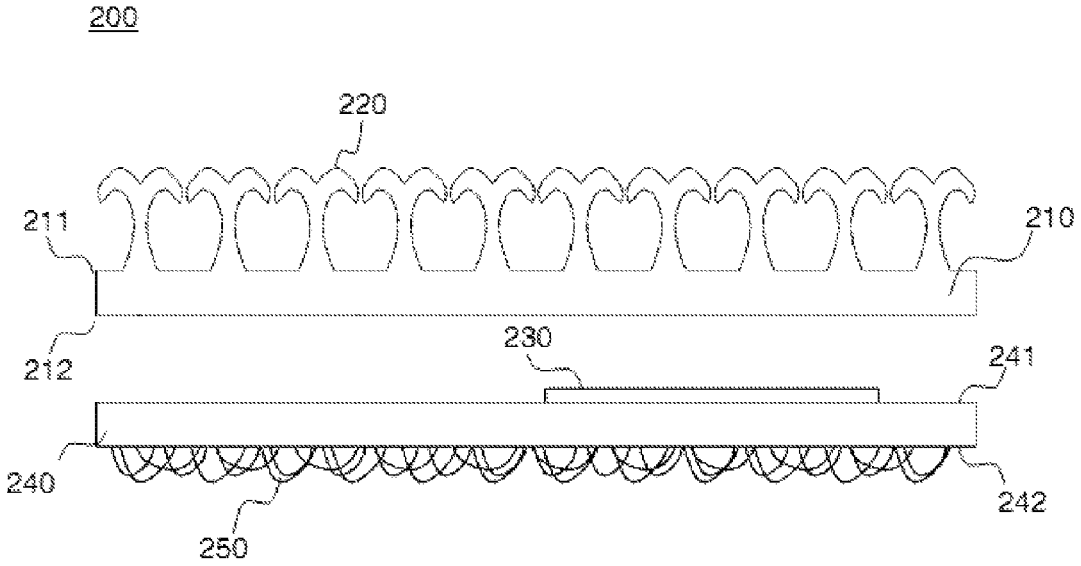
FIG. 2 is a sectional view of a fastening strap according to a second embodiment of the present invention.

FIG. 2 shows a sectional view of a fastening strap 200 according to a second embodiment of the present invention, wherein the fastening strap 200 essentially includes a first band 210 and a second band 240. The first band 210 is made of a transparent material and has a first surface 211 and a second surface 212. The first surface 211 of the first band 210 is protrudingly provided with a plurality of hooks 220 having main features identical to those of the hooks 120 in the first preferred embodiment. The second band 240 has a third surface 241 and a fourth surface 242. The third surface 241 of the second band 240 is adhered directly to the second surface 212 of the first band 210. The fourth surface 242 is formed with a plurality of loops 250 for being mechanically latched by the plurality of hooks 220 on the first surface 211. The third surface 241 of the second band 240 is printed with at least one monochromatic or multicolored pattern 230, which is visible through the first surface 211 of the first band 210 after the first band 210 and the second band 240 are adhered together. A head end, a tail end and a middle section of the fastening strap 200 as well as corresponding end/section widths and openings formed therein are defined in the same way as with the fastening strap 100 in the first preferred embodiment and will not be explained repeatedly here.

Figure 3:
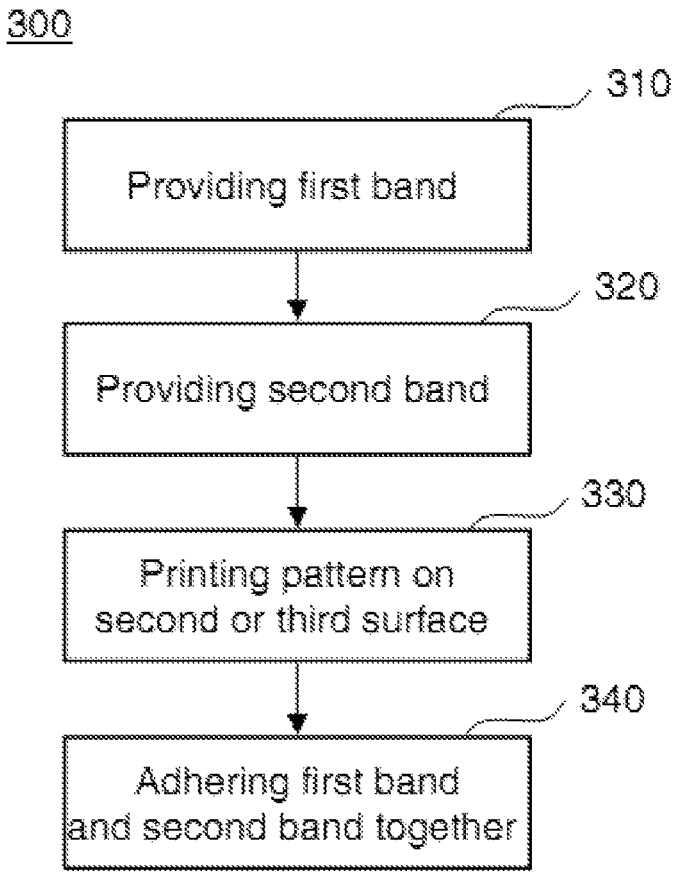
FIG. 3 is a flowchart of a manufacturing method of a fastening strap according to a third embodiment of the present invention.

Referring to FIG. 3, which is a flowchart of a manufacturing method 300 of a fastening strap according to a third embodiment of the present invention, the manufacturing method 300 essentially includes the following steps.

At step 310, a first band made of a transparent material is provided, wherein the first band has a first surface and a second surface, and the first surface is protrudingly provided with a plurality of hooks whose main features are identical to those of the hooks 120 in the first embodiment.

At step 320, a second band is provided, wherein the second band has a third surface and a fourth surface, and the fourth surface is formed with a plurality of loops for being mechanically latched by the hooks on the first surface.

At step 330, at least one pattern is printed on the second surface or the third surface, wherein the pattern is monochromatic or multicolored, and is printed by screen printing or ink-jet printing.

At step 340, the second surface of the first band and the third surface of the second band are directly adhered together.

According to a fourth embodiment of the present invention, a fastening strap essentially includes a first band and a second band. The first band is made of a transparent material and has a first surface and a second surface. The first surface of the first band is protrudingly provided with a plurality of hooks. The second band has a third surface and a fourth surface. The third surface of the second band is directly adhered to the second surface of the first band. The fourth surface of the second band is formed with a plurality of loops for being mechanically latched by the plurality of hooks on the first surface of the first band. Both the first band and the second band are made of a thermoplastic material. In addition, the second surface of the first band or the third surface of the second band is printed with at least one pattern. The first band and the second band are bonded together by a thermoplasticizing process, and the pattern is visible through the first surface of the first band after the two bands are bonded together.

According to a fifth embodiment of the present invention, a fastening strap essentially includes a first band and a second band. The first band is made of a transparent material and has a first surface and a second surface. The first surface is protrudingly provided with a plurality of hooks. The second band has a third surface and a fourth surface. The third surface of the second band is directly adhered to the second surface of the first band. The fourth surface is formed with a plurality of loops for being mechanically latched by the hooks on the first surface. In this embodiment, the fastening strap has at least one pattern printed on the second surface or the third surface, and the pattern is visible through the first surface of the first band after the two bands are adhered together.

While the present invention has been demonstrated with embodiments and corresponding drawings, it should be understood by one skilled in the art that that the embodiments are provided for illustrative purposes only but not intended to limit the scope of the present invention. In other words, changes or modifications which are made to the disclosed elements and do not depart from the spirit of the present invention should fall within the scope of the present invention, which is defined only by the appended claims.

The invention claimed is:

1. A fastening strap, comprising:

a first band having a first surface protrudingly provided with a plurality of hooks, and a second surface; and a second band having a third surface directly adhered to the second surface of the first band, and a fourth surface formed with a plurality of loops for being mechanically latched by the plurality of hooks on the first surface;

the fastening strap being characterized in that:

the first band is made of a transparent, thermoplastic material and the second band is made of a thermoplastic material, wherein one of the second surface and the third surface is partially printed with at least one pattern visible through the first surface of the first band after the first band and the second band are directly bonded together without an extra layer existed therebetween; and each of the plurality of hooks is formed with a stem portion with one end of the stem portion being attached to the first surface and the other end of the stem portion being provided with two hook portions extending therefrom in opposite directions, respectively;

wherein the stem portion is tapered upward from the first surface and widened toward the two hook portions and a concave portion having a nadir is formed between the two hook portions, each of the two hook portions has an upper surface having an upper-surface apex and a lower surface having a lower-surface apex, and a vertical distance between the lower-surface apex and a distal end of the lower surface of the hook portion being smaller than a vertical distance between the lower-surface apex and the upper-surface apex, and the vertical distance between the lower-surface apex and the upper-surface apex being smaller than a vertical distance between the nadir and the upper-surface apex; and wherein the at least one pattern is a very thin layer of ink with a graphic design and is not exposed to the outside and is unlikely to be damaged, and areas outside the graphic design are without ink.

* * * * *